US007377517B2

(12) United States Patent
Andrén et al.

(10) Patent No.: US 7,377,517 B2
(45) Date of Patent: May 27, 2008

(54) TARGET DEVICE

(75) Inventors: Robert Andrén, Huskvarna (SE); Ronnie Larsson, Orlando, FL (US)

(73) Assignee: SAAB AB, Linköping (SE)

( * ) Notice: Subject to any disclaimer, the term of this patent is extended or adjusted under 35 U.S.C. 154(b) by 0 days.

(21) Appl. No.: 10/555,380

(22) PCT Filed: Apr. 22, 2004

(86) PCT No.: PCT/SE2004/000615

§ 371 (c)(1),
(2), (4) Date: Aug. 3, 2006

(87) PCT Pub. No.: WO2004/099706

PCT Pub. Date: Nov. 18, 2004

(65) Prior Publication Data

US 2007/0013137 A1 Jan. 18, 2007

(30) Foreign Application Priority Data

May 9, 2003 (SE) ..... 0301360

(51) Int. Cl.
*F41J 2/02* (2006.01)

(52) U.S. Cl. ..... 273/348.1

(58) Field of Classification Search ..... 273/348.1, 273/407; 607/98, 99; 219/212
See application file for complete search history.

(56) References Cited

U.S. PATENT DOCUMENTS 4,031,352 A * 6/1977 Oosterberg ..... 219/212
4,063,069 A * 12/1977 Peeri ..... 219/545
4,279,599 A * 7/1981 Marshall et al. ..... 273/348.1
4,346,901 A * 8/1982 Booth ..... 273/348.1
4,405,132 A 9/1983 Thalmann
4,540,878 A * 9/1985 Sato ..... 219/545
5,065,032 A 11/1991 Prosser
5,924,694 A * 7/1999 Kent ..... 273/408
6,337,475 B1 * 1/2002 Migliorini ..... 250/208.1
6,556,779 B1 * 4/2003 Stabile ..... 392/437
6,561,072 B1 * 5/2003 Laine et al. ..... 89/1.13
2004/0069760 A1 * 4/2004 Carr et al. ..... 219/212

FOREIGN PATENT DOCUMENTS

EP 0156070 A2 10/1985
EP 0218372 A1 4/1987
GB 2257499 A * 1/1993
SE 465795 B 10/1991

* cited by examiner

*Primary Examiner*—Mark S Graham
(74) *Attorney, Agent, or Firm*—Venable LLP; Eric J. Franklin

(57) ABSTRACT

A target device for firing practice. At least one thermal target surface is heated by an electrically current passing through same. The thermal target surface includes a number of current coils arranged so as to conduct the current from a first area of the target surface to a second area. Each current coil includes current conductors disposed essentially in parallel with one another at a first distance from one another. The current conductors are connected to one another at their ends so that they form the current coil from the first area to the second area. Proximate current coils are mutually connected via bridges.

19 Claims, 1 Drawing Sheet

TARGET DEVICE

TECHNICAL AREA

This invention concerns a target device for firing practice as per the preamble to claim 1.

STATE OF THE ART

In firing practice and tactical exercises involving weapons equipped with thermal sights, target figures that exhibit as realistic a signature as possible are needed. As a result, target surfaces whose heat radiation properties are as similar to those of the actual targets as possible are sought after. The target surfaces may resemble, e.g. tank targets.

Known thermal targets constructed of modules comprise a foil of relatively high resistivity. To achieve the desired heat radiation, there is a need for a corresponding relatively high electrical voltage, which is undesirable from a safety standpoint. The modules can alternatively be equipped with a low-resistivity foil such as aluminum foil, and electrical current is applied at low voltage and high amperage. However, this design requires that a transformer be disposed at the target, and that extremely robust electrical wires connect the transformer to the modules, with the disadvantages entailed thereby.

SE 465 795 describes a known target device for firing practice with live ammunition. The target device is heated by an electrical current of moderate voltage and amperage. It is intended to withstand hits by live ammunition without its thermal properties being notably affected. The target device comprises a thermal target surface heated by an electrical current passing through same. The thermal target surface of the target device comprises a thin metal layer divided into two sections with relatively large current cross-sections to conduct electrical current back and forth. Between these two sections there is a third section with a relatively small current cross-section. The third section comprises a large number of current paths of a first type having high resistance that are disposed transversely to the prevailing direction of electrical current flow.

When a relatively large area of penetration is created in this target device, it has however been shown that electrical conductivity and consequently heat radiation is entirely or partly eliminated around the area of penetration The heat radiation from the target device thus no longer resembles the radiation from a real target.

SUMMARY OF THE INVENTION

One object of the present invention is to prolong the service life of the aforedescribed target devices by constructing them so that their thermal properties are affected less by hits from live ammunition.

This has been achieved by means of a target device for firing practice comprising at least one thermal target surface heated by an electrical current passing through same, wherein the thermal target surface comprises a number of current coils arranged so as to conduct the current from a first area of the target surface to a second area. The current coils are made of aluminum or some other electrically conductive metal and are preferably disposed in parallel in relation to one another. Each current coil contains current conductors disposed essentially in parallel with one another at a first distance from one another, which current conductors are connected with one another at their ends so that they form said current coil from the first area to the second area.

Proximate current coils are mutually connected with one another via bridges. The bridges are preferably arranged at a second distance from one another that is greater than the first distance. For example, the second distance is five to ten times greater than the first distance, e.g. roughly 20 times greater.

According to a first variant, the thermal target surface comprises a first substrate on which the current coils are disposed. The substrate thus functions like a circuit board laminate. The substrate has high temperature resistance and is made of, e.g. polyester. A protective plastic film can also be disposed on the first substrate so that it covers the current coils. An insulating layer of foam rubber or some other heat-insulating material can be disposed on the surface of the first substrate facing the current coils, which insulating layer insulates the target surface from the underlying material. The function of the insulating layer is thus to prevent heat from being abducted, and to minimize energy losses. The current coils are closed in that current is conducted from the second area to the first. For example, at least one return conductor is disposed between the second and the first area, e.g. connected to one of the edges of the thermal surface, in order to conduct the current back.

According to another variant, the target device comprises, in addition to the first substrate and any plastic film, a return conductor that essentially covers the surface of the first substrate facing the current coils. With the return conductor realized in this way, it becomes extremely unsusceptible to breaks. In order for the current through the return conductor to be interrupted, essentially the entire width of the thermal surface must be penetrated and/or worn/split. The return conductor is made of aluminum or some other conductive metal. In addition, to further strengthen the target surface, the return-conducting surface can be disposed in contact with a second substrate made of, e.g. the same material as the first substrate. An insulating layer of foam rubber or some other heat-insulating material can be disposed on the surface of the second substrate facing the surface of the return-conducting surface.

The target device according to the invention withstands penetration without notable degradation of its heat-generating capacity, while at the same time also withstanding splitting effects, which normally occur in connection with penetration by high-velocity projectiles. When damage (projectile penetration, tearing, etc.) to the thermal target surface takes place, only local heating occurs around the actual damage. The target device is also simple and inexpensive to produce. According to the second embodiment, in which the target surface comprises a return conductor and a second substrate belonging to the return conductor, the target surface exhibits additional resistance to splitting.

BRIEF DESCRIPTION OF THE DRAWINGS

The invention will be described in greater detail below with the help of exemplary embodiments, and with reference to the accompanying drawing. The figures show the following.

DETAILED DESCRIPTION OF THE INVENTION

Figure 1:
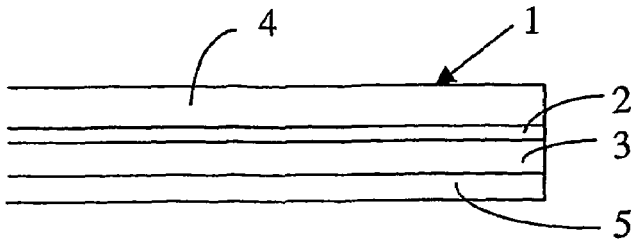
FIG. 1 shows a heating mat for a thermal target device according to a first embodiment of the invention.

FIG. 1 shows a heating mat 1 for a thermal target device, a circuit layer 2 consisting of a pattern of aluminum pathways etched onto a substrate layer 3 of polyester. The circuit layer 2, which will be described in greater detail below, is arranged so as to conduct current, whereupon heat is generated. On top of the circuit layer 2 there is disposed a layer 4 of a plastic film, which stabilizes and protects the aluminum circuit. The plastic film can be dulled to reduce reflections from its surface. The plastic film is made of, e.g. polyethylene or polyester. A layer 5 of heat-insulating material is disposed on the side of the substrate layer 3 facing the circuit layer 2 in order to prevent heat from radiating out from the rear of the mat. The heat-insulating material is made of, e.g. foam rubber. The circuit layer 2 is electrically connected by means of one or more return conductors (not shown) at one edge of the mat by means of, e.g. connectors (not shown). At an opposite edge of the mat there is a current connector (not shown) for connecting a voltage source, characteristically 12V or 24V. The return conductor(s) is/are then arranged so as to conduct the current between the aforementioned opposite edges of the mat.

Figure 2:
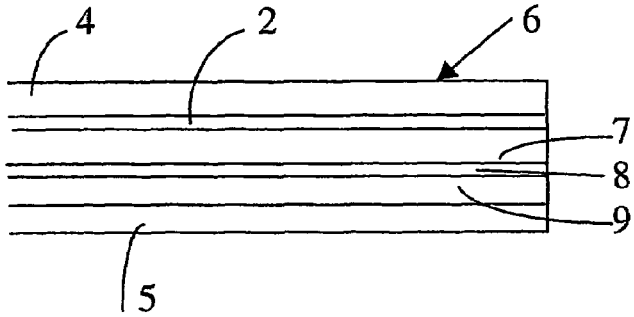
FIG. 2 shows a heating mat for a thermal target device according to a second embodiment of the invention.

FIG. 2 shows an alternative heating mat 6 for a thermal target device, the aforementioned circuit layer 2 consisting of a pattern of aluminum pathways etched on a first substrate layer 7 of polyester. On top of the circuit layer 2 there is disposed the aforedescribed plastic film layer 4. An electrically conductive layer 8 that functions as a return conductor for the current through the circuit layer 2 is disposed on the side of substrate layer 7 facing the circuit layer 2. The return conductor layer 8 consists of a layer of conductive metal, such as aluminum, that covers essentially the entire substrate surface 7. The return conductor is, on its side facing the first substrate 7, etched on a second substrate layer 9 made of, e.g. polyester. The layer 5 of insulating material described in conjunction with FIG. 1 is disposed behind the second substrate layer. The circuit layer 2 and return conductor layer 8 are electrically connected via, e.g. connectors (not shown) at one edge of the mat, while a current connector (not shown) for connecting to a voltage source, characteristically 12V or 24V, is present at the opposite edge of the mat.

By virtue of the double substrate layers 7,9, the alternative heating mat described in conjunction with FIG. 2 exhibits increased tear resistance compared to the heating mat 1 described in conjunction with FIG. 1, as a result of which the tendency to split and tear is reduced when high-velocity projectiles strike the heating mat. Consequently, the heating mat described in conjunction with FIG. 2 is particularly suitable for use in tank applications, while the heating mat described in conjunction with FIG. 1 is fully sufficient for infantry applications.

Figure 3:
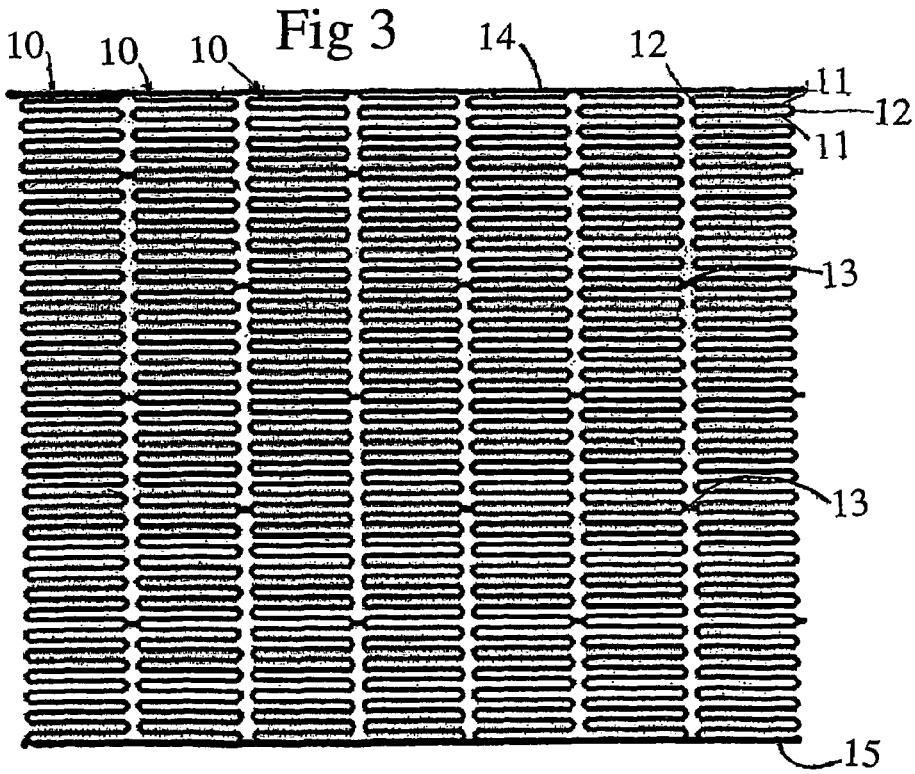
FIG. 3 shows a conduction pattern for a heating mat according to either of the two embodiments.

In FIG. 3, the circuit layer pattern 2 consists of a number of current coils 10 that are arranged in parallel and conduct the current from the edge 14 of the mat that is connected to the voltage source to its opposite edge 15. The current coils 10 are connected at the opposite edge to the return conductor, which in turn connects to the negative pole of the voltage source. For example, the mats 1, 6 comprise approximately 30 parallel current coils 10 per meter of mat. Each current coil 10 comprises conducting elements 11 disposed at a distance from one another and having edges 14, 15. In the foregoing example, the lengths of the conducting elements are approximately 30 mm or somewhat shorter. The distance between the parallel conducting elements 11 is 1-3 mm, e.g. 2 mm. The conducting elements 11 are connected to one another at their ends by means of connectors 12 so that they form the current coil 10, which conducts the current from the power-supplied edge 14 to the opposite edge 15. Proximate current coils are also mutually connected with one another via bridges 13. The bridges 13 between twin adjacent current coils 10 are, e.g. realized every 40 mm.

The resistance values for the coils in the circuit layer pattern are chosen based on the desired output, the size of the surface is to be heated, and the applied voltage. A suitable output can fall within the range of 125-500 $W/m^2$, e.g. 250 $W/m^2$. All the coils in the circuit layer pattern preferably have the same dimensions, and thus the same resistance value per unit of length.

The invention claimed is:

1. A target device for firing practice, comprising:

at least one thermal target surface comprising a plurality of current coils each comprising a plurality of electrically conductive elements and a plurality of connectors connecting together ends of the conducting elements, the conducting elements being arranged at a first distance from each other symmetrically transverse to an axis representing the prevailing direction of current flow for the respective current coil, each current coil having a predetermined resistance and conducting current from a first area of the thermal target surface to a second area of the thermal target surface; and a plurality of bridges connecting adjacent current coils and arranged from each other at a second distance that is greater than the first distance.

2. The target device according to claim 1, wherein the current coils comprise an electrically conductive metal.

3. The target device according to claim 1, wherein the current coils are parallel to each another.

4. The target device according to claim 1, wherein the second distance is 5 to 30 times greater than the first distance.

5. The target device according to claim 1, wherein the second distance is approximately 20 times greater than the first distance.

6. The target device according to claim 1, wherein the thermal target surface further comprises a first substrate comprising a first surface on which the current coils are arranged.

7. The target device according to claim 6, wherein the thermal target surface further comprises a plastic film arranged on the first substrate such that the plastic film covers the current coils.

8. The target device according to claim 6, wherein the thermal target surface further comprises an insulating layer on which the first substrate is arranged.

9. The target device according to claim 6, wherein the thermal target surface further comprises a return-conducting layer arranged on a second surface of the first substrate opposite the first surface on which the current coils are arranged.

10. The target device according to claim 9, wherein the thermal target surface further comprises a second substrate which contacts the return-conducting layer.

11. The target device according to claim 10, wherein the thermal target surface further comprises an insulating layer on which the second substrate is arranged.

12. The target device according to claim 6, wherein the first substrate comprises polyester.

13. The target device according to claim 8, wherein the insulating layer comprises foam rubber.

14. The target device according to claim 1, wherein current coils and bridges comprise aluminum.

15. The target device according to claim 9, wherein the return-conducting layer is made essentially of aluminum.

16. A target device for firing practice, comprising:

at least one thermal target surface comprising a first substrate;

a plurality of current coils arranged on the first substrate, each current coil comprising a plurality of electrically conductive elements and a plurality of connectors connecting together ends of the conducting elements, the conducting elements being arranged at a first distance from each other symmetrically transverse to an axis representing the prevailing direction of current flow for the respective current coil, each current coil having a predetermined resistance and conducting current from a first area of the thermal target surface to a second area of the thermal target surface;

a plurality of bridges connecting adjacent current coils; and a return-conducting layer essentially covering a second surface of the first substrate opposite the first surface on which the current coils are arranged.

17. The target device according to claim 16, wherein the thermal target surface further comprises a second substrate which contacts the return-conducting layer.

18. The target device according to claim 17, wherein the thermal target surface further comprises an insulating layer on which the second substrate is arranged.

19. The target device according to claim 16, wherein the return-conducting layer is made essentially of aluminum.

* * * * *